US011808502B2

(12) United States Patent
Yamazoe et al.

(10) Patent No.: US 11,808,502 B2
(45) Date of Patent: Nov. 7, 2023

(54) RAW MATERIAL GAS LIQUEFYING DEVICE AND METHOD OF CONTROLLING THIS RAW MATERIAL GAS LIQUEFYING DEVICE

(71) Applicant: KAWASAKI JUKOGYO KABUSHIKI KAISHA, Kobe (JP)

(72) Inventors: Naotaka Yamazoe, Akashi (JP); Tomohiro Sakamoto, Akashi (JP); Hidetaka Miyazaki, Kobe (JP); Daisuke Kariya, Kobe (JP); Yasuo Miwa, Kobe (JP); Yuichi Saito, Akashi (JP); Yosuke Kimura, Kakogawa (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 1003 days.

(21) Appl. No.: 16/465,430

(22) PCT Filed: Dec. 4, 2017

(86) PCT No.: PCT/JP2017/043510
§ 371 (c)(1),
(2) Date: May 30, 2019

(87) PCT Pub. No.: WO2018/105565
PCT Pub. Date: Jun. 14, 2018

(65) Prior Publication Data

US 2020/0003070 A1 Jan. 2, 2020

(30) Foreign Application Priority Data

Dec. 8, 2016 (JP) ..... 2016-238535

(51) Int. Cl.
*F25B 9/06* (2006.01)
*F25J 1/00* (2006.01)
*F25J 1/02* (2006.01)

(52) U.S. Cl.
CPC ..... *F25B 9/06* (2013.01); *F25J 1/001* (2013.01); *F25J 1/005* (2013.01); *F25J 1/0007* (2013.01);
(Continued)

(58) Field of Classification Search
CPC ..... F25B 9/06; F25J 1/001; F25J 1/005; F25J 1/0248; F25J 1/0067; F25J 1/0247; F25J 1/0204; F25J 1/0005; F25J 1/0062
See application file for complete search history.

(56) References Cited

U.S. PATENT DOCUMENTS 3,939,328 A * 2/1976 Davis ..... F01K 13/02 290/40 R
2006/0222523 A1* 10/2006 Valentian ..... F17C 7/04 417/313

(Continued)

FOREIGN PATENT DOCUMENTS

JP H01-269875 A 10/1989
JP 2016-183827 A 10/2016

*Primary Examiner* — John F Pettitt, III
(74) *Attorney, Agent, or Firm* — Oliff PLC

(57) ABSTRACT

A raw material gas liquefying device includes a feed line which feeds a raw material gas, a refrigerant circulation line which circulates a refrigerant, the refrigerant circulation line including an expansion unit of a turbine type which expands the refrigerant to generate cryogenic energy, and an expansion unit entrance valve provided at an entrance side of the expansion unit, a heat exchanger which exchanges heat between the raw material gas and the refrigerant, a cooler which performs initial cooling of the raw material gas and the refrigerant by heat exchange with liquid nitrogen, and a controller which manipulates the opening rate of the expansion unit entrance value and performs a feedback control so that the rotation speed of the expansion unit reaches a predetermined target value, and outputs the opening rate
(Continued)

command to the expansion unit entrance valve, at start-up and stop of the expansion unit.

10 Claims, 6 Drawing Sheets

(52) U.S. Cl.
CPC ..... *F25J 1/0052* (2013.01); *F25J 1/0065* (2013.01); *F25J 1/0067* (2013.01); *F25J 1/0204* (2013.01); *F25J 1/0221* (2013.01); *F25J 1/0244* (2013.01); *F25J 2210/42* (2013.01); *F25J 2215/32* (2013.01); *F25J 2270/16* (2013.01)

(56) References Cited

U.S. PATENT DOCUMENTS

| | | | | |
|---|---|---|---|---|
| 2014/0053598 | A1* | 2/2014 | Ishimaru | F25J 1/001 62/606 |
| 2017/0058702 | A1* | 3/2017 | Park | F01D 17/145 |
| 2017/0058717 | A1* | 3/2017 | Matsumoto | F01K 7/16 |
| 2017/0138220 | A1* | 5/2017 | Fujimura | F01D 17/145 |
| 2017/0152762 | A1* | 6/2017 | Murakami | F02C 3/04 |

* cited by examiner

RAW MATERIAL GAS LIQUEFYING DEVICE AND METHOD OF CONTROLLING THIS RAW MATERIAL GAS LIQUEFYING DEVICE

TECHNICAL FIELD

The present invention relates to a raw material s liquefying device which liquefies a raw material gas to be liquefied at a cryogenic temperature, such as a hydrogen gas, and a method of controlling this raw material gas liquefying device.

BACKGROUND ART

For example, a raw material gas liquefying device which liquefies a raw material gas to be liquefied at a cryogenic temperature, such as a hydrogen gas, is conventionally known. Patent Literature 1 discloses this technique.

The raw material gas liquefying device disclosed in Patent Literature 1 has been conceived by the inventors of the present application, and is a prior art of the present application. This raw material gas liquefying device includes, for example, a feed line which flows therethrough a raw material gas to be liquefied, a refrigerant circulation line which flows therethrough a refrigerant for cooling the raw material gas, heat exchangers which exchange heat between the raw material gas and the refrigerant, and a cooler which performs initial cooling of the raw material gas and the refrigerant by heat exchange with liquid nitrogen. The refrigerant circulation line is provided with a compressor, an expansion unit of a turbine type (expansion turbine), an expansion unit entrance valve which adjusts the flow rate of the refrigerant flowing into the expansion unit, and an expansion unit bypass valve which bypasses the expansion unit. The refrigerant flowing through the refrigerant circulation line is compressed by the compressor, is decreased in temperature by adiabatic expansion in the expansion unit, and exchanges heat with the raw material gas in the heat exchanger so that its temperature is increased. After that, the refrigerant is returned to the compressor.

In the raw material gas liquefying device disclosed in Patent Literature 1, a gas bearing unit is used as a rotor bearing of the expansion unit. Before start-up (activation) of the expansion unit, the refrigerant which has gone through (has been subjected to) the initial cooling is flowed to the gas bearing unit. In this way; the initial cooling of the expansion unit is performed.

In the raw material gas liquefying device disclosed in Patent Literature 1, the opening rate of the expansion unit entrance valve and the opening rate of the expansion unit bypass valve are changed according to pre-set valve opening rate schedules. In this way, start-up (activation) and stop of the expansion unit are performed while reducing a load to the heat exchangers and reducing a shaft vibration (oscillation) of the expansion unit.

CITATION LIST

Patent Literature

Patent Literature 1: Japanese-Laid Open Patent Application Publication No. 2016-183827

SUMMARY OF INVENTION

Technical Problem

In general, operation characteristics (rotation start and stop characteristics) of the expansion unit are varied from operation to operation, due to, for example, deterioration of components which progresses over time, and adhesion of impurities contained in the raw material gas or the refrigerant to the bearing. In the raw material gas liquefying device disclosed in Patent Literature 1, the opening rate of the expansion unit entrance valve and the opening rate of the expansion unit bypass valve are changed according to the valve opening rate schedules. However, the change of the operation characteristics is not considered for a change of the rotation speed of the expansion unit which is associated with the changes of the opening rates of the valves. In this respect, the art disclosed in Patent Literature 1 has a room for improvement.

Solution to Problem

According to an aspect of the present invention, a raw material gas liquefying device comprises: a feed line which feeds a raw material gas whose boiling temperature is lower than a boiling temperature of nitrogen; a refrigerant circulation line which circulates a refrigerant for cooling the raw material gas, the refrigerant circulation line including an expansion unit of a turbine type which expands the refrigerant to generate cryogenic energy, and an expansion unit entrance valve provided at an entrance side of the expansion unit; a heat exchanger which exchanges heat between the raw material gas and the refrigerant; a cooler which performs initial cooling of the raw material gas and the refrigerant by heat exchange with liquid nitrogen; an expansion unit rotation speed sensor which detects a rotation speed of the expansion unit; and a controller which generates an opening rate command for the expansion unit entrance valve by performing a feedback control so that the rotation speed of the expansion unit reaches a predetermined target value, and outputs the opening rate command to the expansion unit entrance valve, at start-up and stop of the expansion unit.

According to another aspect of the present invention, a method of controlling a raw material gas liquefying device including: a feed line which feeds a raw material gas whose boiling temperature is lower than a boiling temperature of nitrogen; a refrigerant circulation line which circulates a refrigerant for cooling the raw material gas, the refrigerant circulation line including an expansion unit of a turbine type which expands the refrigerant to generate cryogenic energy, and an expansion unit entrance valve provided at an entrance side of the expansion unit; a heat exchanger which exchanges heat between the raw material gas and the refrigerant; a cooler which performs initial cooling of the raw material gas and the refrigerant by heat exchange with liquid nitrogen; and a controller which controls operations associated with the feed line and the refrigerant circulation line, the method comprising: manipulating an opening rate of the expansion unit entrance valve and performing a feedback control so that a rotation speed of the expansion unit reaches a predetermined target value, at start-up and stop of the expansion unit.

In accordance with the raw material gas liquefying device and the control method thereof (therefor), described above, the rotation speed of the expansion unit is directly controlled at start-up and stop of the expansion unit, Therefore, even in a case where the operation characteristics of the expansion unit change, it becomes possible to avoid a situation in which the rotation speed of the expansion unit unexpectedly falls into the critical speed zone at the start-up and stop of the expansion unit. Since the rotation speed of the expansion unit is controlled so that the rotation speed quickly passes through the critical speed zone, the shaft vibration of the expansion unit can be suppressed. As a result, it becomes possible to avoid damages due to excessive shaft vibration of the expansion unit, for example, seizure of the bearing of the expansion unit.

Advantageous Effects of Invention

In accordance with the present invention, even in a case where the operation characteristics of the expansion unit change, it becomes possible to avoid a situation in which the rotation speed of the expansion unit unexpectedly falls into the critical speed zone at the startup and stop of the expansion unit.

DESCRIPTION OF EMBODIMENTS

Figure 1:
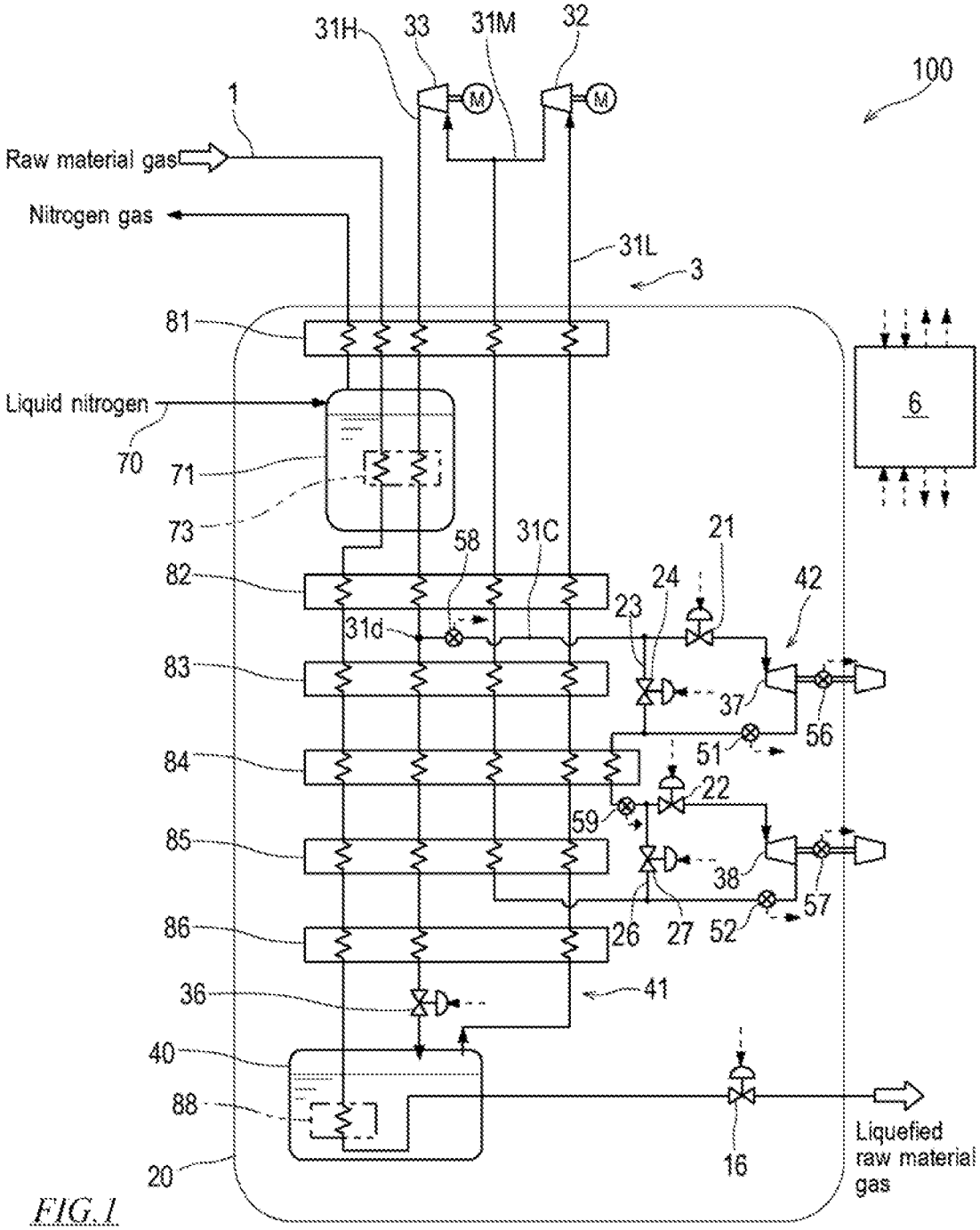
FIG. 1 is a view showing the overall configuration of a raw material gas liquefying device according to one embodiment of the present invention.
Figure 2:
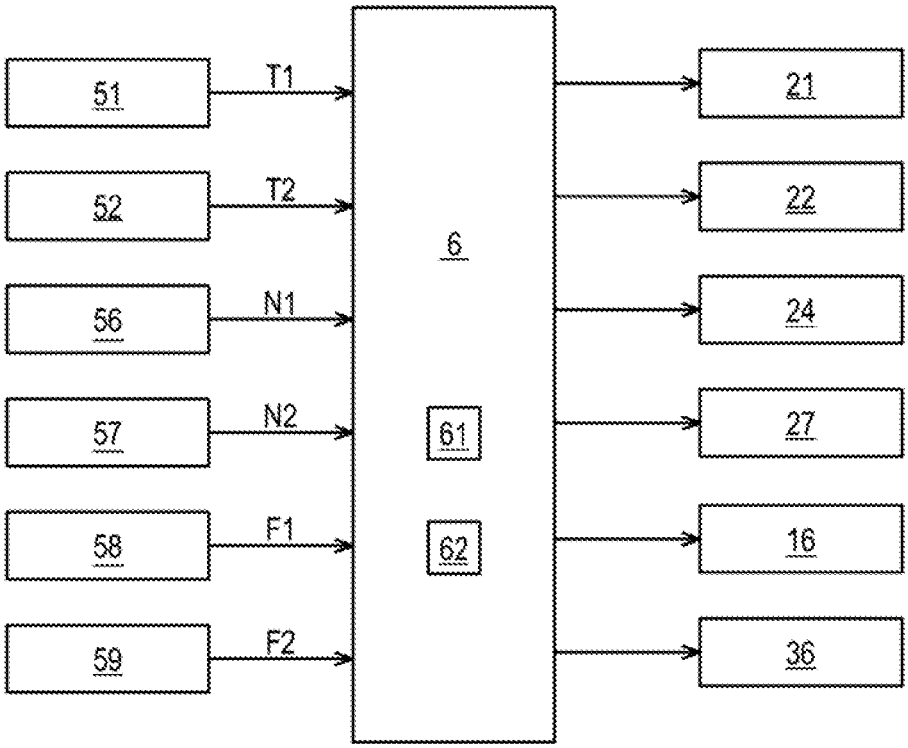
FIG. 2 is a block diagram showing the configuration of a control of the raw material gas liquefying device.

Hereinafter, the embodiment of the present invention will be described with reference to the drawings. FIG. 1 is a view showing the overall configuration of a raw material gas liquefying device 100 according to one embodiment of the present invention. FIG. 2 is a block diagram showing the configuration of a control system of the raw material gas liquefying device 100. The raw material gas liquefying device 100 according to the present embodiment is configured to cool and liquefy a raw material gas supplied to the raw material gas liquefying device 100 to generate a liquefied raw material gas. In the present embodiment, a high-purity hydrogen gas is used as the raw material gas. As the liquefied raw material gas, liquid hydrogen is generated. However, the raw material gas is not limited to the hydrogen gas so long as the raw material gas is in a gaseous state at a room temperature and a normal pressure and its boiling temperature is lower than that (minus 196 degrees C.) of a nitrogen gas. As the raw material gas, for example, there are the hydrogen gas, a helium gas, and a neon gas.

As shown in FIGS. 1 and 2, the raw material gas liquefying device 100 includes a feed line 1 which flows the raw material gas therethrough, a refrigerant circulation line 3 which circulates a refrigerant therethrough, and a controller 6 which controls the operation of the raw material gas liquefying device 100, The raw material gas liquefying device 100 includes heat exchangers 81 to 86 at multiple stages, which exchange heat between the raw material gas flowing through the feed line 1 and the refrigerant flowing through the refrigerant circulation line 3, and coolers 73, 88.

[Configuration of Feed Line 1]

The feed line 1 is a flow path which flows the raw material gas therethrough. The feed line 1 includes high-temperature-side flow paths inside the heat exchangers 81 to 86, flow paths inside the coolers 73, 88, a feed system Joule-Thomson valve (hereinafter will be referred to as "feed system JT valve 16"), flow paths inside pipes connecting them to each other, and the like. The raw material gas with a room temperature and a normal pressure, which has been compressed (whose pressure has been increased) by a compressor (not shown) or the like, is fed to the feed line 1.

The feed line 1 passes through the heat exchanger 81 at a first stage, the cooler 73 for initial cooling, the heat exchangers 82 to 86 at second to sixth stages, the cooler 88, and the feed system JT valve 16 in this order. In the heat exchangers 81 to 86, heat exchange between the raw material gas and the refrigerant takes place. In this way, the raw material gas is cooled.

The feed line 1 passes through the heat exchanger 81 at the first stage and then through the cooler 73 for initial cooling, before it enters the heat exchanger 82 at the second stage. The cooler 73 for initial cooling includes a liquid nitrogen storage tank 71 storing liquid nitrogen therein, and a nitrogen line 70 which externally feeds the liquid nitrogen to the liquid nitrogen storage tank 71. The feed line 1 extends through the inside of the liquid nitrogen storage tank 71, The cooler 73 for initial cooling cools the raw material gas and the refrigerant to a temperature that is almost equal to that of the liquid nitrogen.

The feed line 1 passes through the heat exchanger 86 at the sixth stage and then through the cooler 88, before it enters the feed system if valve 16, The cooler 88 includes a liquefied refrigerant storage tank 40 which stores therein a liquefied refrigerant generated by liquefying the refrigerant in the refrigerant circulation line 3. The feed line 1 extends through the inside of the liquefied refrigerant storage tank 40. The cooler 88 cools the raw material gas to a temperature (specifically; cryogenic temperature) that is approximately equal to a temperature of the liquefied refrigerant, with the liquefied refrigerant stored in the liquefied refrigerant storage tank 40.

The raw material gas with the cryogenic temperature exits the cooler 88 and then flows into the feed system JT valve 16. At the feed system. JT valve 16, the raw material gas with the cryogenic temperature is liquefied to liquid with a low temperature and a normal pressure, by Joule-Thomson expansion. The raw material gas (liquefied raw material gas) liquefied in this way is sent to a storage tank (not shown) and stored therein. The generation amount (liquefaction amount) of the liquefied raw material gas is adjusted according to the opening rate (opening degree) of the feed system JT valve 16.

[Configuration of Refrigerant Circulation Line 3]

The refrigerant circulation line 3 is a closed flow path which circulates the refrigerant therethrough. The refrigerant circulation line 3 includes flow paths inside the heat exchangers 81 to 86, flow path inside the cooler 73, two compressors 32, 33, two expansion units 37, 38, a circulation system Joule-Thomson valve (hereinafter will be referred to as "circulation system JT valve 36"), the liquefied refrigerant storage tank 40, flow paths inside pipes connecting them, and the like. In the feed line 1 and the refrigerant circulation line 3, a section including the heat exchangers 81 to 86 at the first to sixth stages, the cooler 73 for initial cooling, the cooler 88, and the expansion units 37, 38 is constructed as a liquefier 20.

A filling line (not shown) for filling the refrigerant is connected to the refrigerant circulation line 3. In the present embodiment, hydrogen is used as the refrigerant. However, the refrigerant is not limited to hydrogen and may be any substance which is in a gaseous state at a room temperature and a normal pressure, and whose boiling temperature is equal to Or lower than that of the raw material gas. As the refrigerant, for example, there are hydrogen, helium, and neon.

The refrigerant circulation line 3 includes two circulation flow paths (closed loop) which are a refrigerant liquefaction route 41 and a cryogenic energy (cold energy) generation route 42 which partially share flow paths. The refrigerant liquefaction route 41 passes through the low-pressure-side compressor (hereinafter will be referred to as "low-pressure compressor 32"), the high-pressure-side compressor (hereinafter will be referred to as "high-pressure compressor 33"), a high-temperature-side refrigerant flow path of the heat exchanger 81 at the first stage, the cooler 73 for initial cooling, high-temperature-side refrigerant flow paths of the heat exchangers 82 to 86 at the second to sixth stages, the circulation system JT valve 36, the liquefied refrigerant storage tank 40, and low-temperature-side refrigerant flow paths of the heat exchangers 86 to 81 at the sixth to first stages in this order, and then returns to the low-pressure compressor 32.

A low-pressure flow path 31L is connected to the entrance of the low-pressure compressor 32, The exit of the low-pressure compressor 32 and the entrance of the high-pressure compressor 33 are connected to each other by a medium-pressure flow path 31M. The refrigerant in the low-pressure flow path 31L is compressed by the low-pressure compressor 32 and discharged to the medium-pressure flow path 31M. The exit of the high-pressure compressor 33 and the entrance of the circulation system JT valve 36 are connected to each other via a high-pressure flow path 31H. The refrigerant in the medium-pressure flow path 31M is compressed by the high-pressure compressor 33 and discharged to the high-pressure flow path 31H.

The refrigerant in the high-pressure flow path 31H flows through the high-temperature-side refrigerant flow path of the heat exchanger 81 at the first stage, the cooler 73 for initial cooling, and the high-temperature-side refrigerant flow paths of the heat exchangers 82 to 86 at the second to sixth stages, in this order, and is cooled. Then, the refrigerant flows into the circulation system JT valve 36. The refrigerant is liquefied by Joule-Thomson expansion at the circulation system JT valve 36. The liquefied refrigerant flows into the liquefied refrigerant storage tank 40. The generation amount of the liquefied refrigerant is adjusted according to the opening rate (opening degree) of the circulation system JT valve 36.

In the liquefied refrigerant storage tank 40 which stores the liquefied refrigerant therein, a boil-off gas is generated. This boil-off gas flows into the low-pressure flow path 31L connecting the exit of the liquefied refrigerant storage tank 40 to the entrance of the low-pressure compressor 32. The low-pressure flow path 31L passes through the heat exchangers 81 to 86 at the first to sixth stages in an order which is the reverse of the order in which the high-pressure flow path 31H passes. Specifically, the low-pressure flow path 31L passes through the heat exchanger 86 at the sixth stage to the heat exchanger 81 at the first stage in this order. The temperature of the refrigerant in the low-pressure flow path 31L is increased while flowing through the low-temperature-side refrigerant flow paths of the heat exchangers 86 to 81. Then, the refrigerant returns to the entrance of the low-pressure compressor 32.

The cryogenic energy generation route 42 passes through the high-pressure compressor 33, the high-temperature-side refrigerant flow paths of the heat exchangers 81, 82 at the first and second stages, the high-pressure-side expansion unit (hereinafter will be referred to as "high-pressure expansion unit 37"), the heat exchanger 84 at the fourth stage, the low-pressure-side expansion unit (hereinafter will be referred to as "low-pressure expansion unit 38"), and the heat exchangers 85 to 81 at the fifth to first stages in this order, and then returns to the high-pressure compressor 33. The expansion units 37, 38 are the expansion units of a turbine type. The expansion unit 37 is provided with a rotation speed sensor 56 which detects a rotation speed N1 of a rotor shaft of a turbine. The expansion unit 38 is provided with a rotation speed sensor 57 which detects a rotation speed N2 of a rotor shaft of a turbine. In the description and claims, in some cases, the rotation speeds of the rotor shafts of the turbines of the expansion units 37, 38 will be expressed as the rotation speeds of the expansion units 37, 38.

The refrigerant liquefaction route 41 and the cryogenic energy generation route 42 share the flow paths in a range from the high-pressure compressor 33 to the heat exchanger 82 at the second stage. A branch part 31*d* is provided at the high-pressure flow path 31H at a location that is between the exit of the heat exchanger 82 at the second stage and the entrance of the heat exchanger 83 at the third stage. The upstream end of a cryogenic energy generation flow path 31C is connected to the branch part 31*d*. The downstream end of the cryogenic energy generation flow path 31C is connected to the medium-pressure flow path 31M.

In a range from the branch part 31*d* to the medium-pressure flow path 31M, the cryogenic energy generation flow path 31D passes through the high-pressure expansion unit 37, the heat exchanger 84 at the fourth stage, the low-pressure expansion unit 38, and the low-temperature-side refrigerant flow paths of the heat exchangers 85 to 81 at the fifth to first stages. A most part of the refrigerant which has passed through the heat exchanger 82 at the second stage in the high-pressure flow path 31H flows to the cryogenic energy generation flow path 31C by the operation of the high-pressure expansion unit 37, and the remaining refrigerant flows to the heat exchanger 83 at the third stage.

The refrigerant which has flowed into the cryogenic energy generation flow path 31C and has a temperature lower than that of the liquid nitrogen and a high pressure, is expanded by the high-pressure expansion unit 37 so that its pressure and temperature are reduced, flows through the heat exchanger 84 at the fourth stage, and is expanded by the low-pressure expansion unit 38 so that its pressure and temperature are further reduced. The refrigerant with a cryogenic temperature exits the low-pressure expansion unit 38, and then flows through the heat exchanger 85 at the fifth stage to the heat exchanger 81 at the first stage in this order (in other words, cools the raw material gas and the refrigerant in the high-pressure flow path 31H), and joins the refrigerant in the medium-pressure flow path 31M.

The cryogenic energy generation flow path 31C is provided with a high-pressure expansion unit entrance valve 21 which adjusts the flow rate of the refrigerant flowing into the high-pressure expansion unit 37, at the entrance side of the high-pressure expansion unit 37. The cryogenic energy generation flow path 31C is provided with a high-pressure expansion unit entrance-side flow rate sensor 58 which detects a flow rate F1 (hereinafter will be referred to as "high-pressure expansion unit entrance-side flow rate F1") of the refrigerant flowing into the cryogenic energy generation flow path 31C, at a location that is upstream of the high-pressure expansion unit entrance valve 21. The cryogenic energy generation flow path 31C is provided with a high-pressure expansion unit exit temperature sensor 51 which detects a temperature (hereinafter will be referred to as "high-pressure expansion unit exit temperature T1") of the refrigerant which has exited the high-pressure expansion unit 37, at the exit side of the high-pressure expansion unit 37.

Likewise, the cryogenic energy generation flow path 31C is provided with a low-pressure expansion unit entrance valve 22 which adjusts the flow rate of the refrigerant flowing into the low-pressure expansion unit 38, at the entrance side of the low-pressure expansion unit 38, The cryogenic energy generation flow path 31C is provided with a low-pressure expansion unit entrance-side flow rate sensor 59 which detects a flow rate F2 (hereinafter will be referred to as "low-pressure expansion unit entrance-side flow rate F2") of the refrigerant flowing from the high-pressure expansion unit 37 into the low-pressure expansion unit 38, at a location that is upstream of the low-pressure expansion unit entrance valve 22. The cryogenic energy generation flow path 31C is provided with a low-pressure expansion unit exit temperature sensor 52 which detects a temperature (hereinafter will be referred to as "low-pressure expansion unit exit temperature T2") of the refrigerant which has exited the low-pressure expansion unit 38, at the exit side of the low-pressure expansion unit 38.

The upstream end of a high-pressure expansion unit bypass flow path 23 is connected to the cryogenic energy generation flow path 31C, at a location that is upstream of the high-pressure expansion unit entrance valve 21 and downstream of the flow rate sensor 53. The downstream end of the high-pressure expansion unit bypass flow path 23 is connected to the cryogenic energy generation flow path 31C, at a location that is upstream of the heat exchanger 84 and downstream of the high-pressure expansion unit exit temperature sensor 51. In brief, the high-pressure expansion unit bypass flow path 23 connects the entrance side and exit side of the high-pressure expansion unit 37 and bypasses the high-pressure expansion unit 37. The high-pressure expansion unit bypass flow path 23 is provided with a high-pressure expansion unit bypass valve 24.

Likewise, the upstream end of a low-pressure expansion unit bypass flow path 26 is connected to the cryogenic energy generation flow path 31C, at a location that is upstream of the low-pressure expansion unit entrance valve 22 and downstream of the heat exchanger 84. The downstream end of the low-pressure expansion unit bypass flow path 26 is connected to the cryogenic energy generation flow path 31C, at a location that is upstream of the heat exchanger 85 and downstream of the low-pressure expansion unit exit temperature sensor 52. In brief, the low-pressure expansion unit bypass flow path 26 connects the entrance side and exit side of the low-pressure expansion unit 38 and bypasses the low-pressure expansion unit 38. The low-pressure expansion unit bypass flow path 26 is provided with a low-pressure expansion unit bypass valve 27.

[Configuration of Control System of Raw Material Gas Liquefying Device 100]

The controller 6 is a device configured to control the operations associated with the feed line 1 and the refrigerant circulation line 3. In the present embodiment, especially, the controller 6 is a device configured to execute a start-up method and stop (shut-down) method of (for) the raw material gas liquefying device 100, more specifically, a start-up method and stop method of each of the high-pressure expansion unit 37 and the low-pressure expansion unit 38. The controller 6 is configured to control start-up and stop of the high-pressure expansion unit 37 and the low-pressure expansion unit 38 so that the high-pressure expansion unit 37 and the low-pressure expansion unit 38 cooperate with each other.

The raw material gas liquefying device 100 is provided with sensors which detect the process data of the raw material gas liquefying device 100. These sensors are connected to the controller 6 so that the sensors can transmit detection values to the controller 6. For example, the controller 6 is connected to the high-pressure expansion unit exit temperature sensor 51, the low-pressure expansion unit exit temperature sensor 52, the high-pressure expansion unit rotation speed sensor 56, the low-pressure expansion unit rotation speed sensor 57, the high-pressure expansion unit entrance-side flow rate sensor 58, and the low-pressure expansion unit entrance-side flow rate sensor 59, and obtains detection values from these sensors.

The controller 6 is configured to manipulate the opening rates of the high-pressure expansion unit entrance valve 21, the low-pressure expansion unit entrance valve 22, the high-pressure expansion unit bypass valve 24, and the low-pressure expansion unit bypass valve 27 of the raw material gas liquefying device 100. The controller 6 is a computer configured to execute programs pre-stored, to function as a start-up (activation) control section 61 and a stop (shut-down) control section 62, Each of these functional blocks of the controller 6 derives the opening rate of the valve based on the process data, and outputs an opening rate command to the corresponding valve. Each valve receives the opening rate command from the controller 6 and operates to realize the opening rate (opening degree) corresponding to the opening rate command.

[Start-Up Control]

Figure 3:
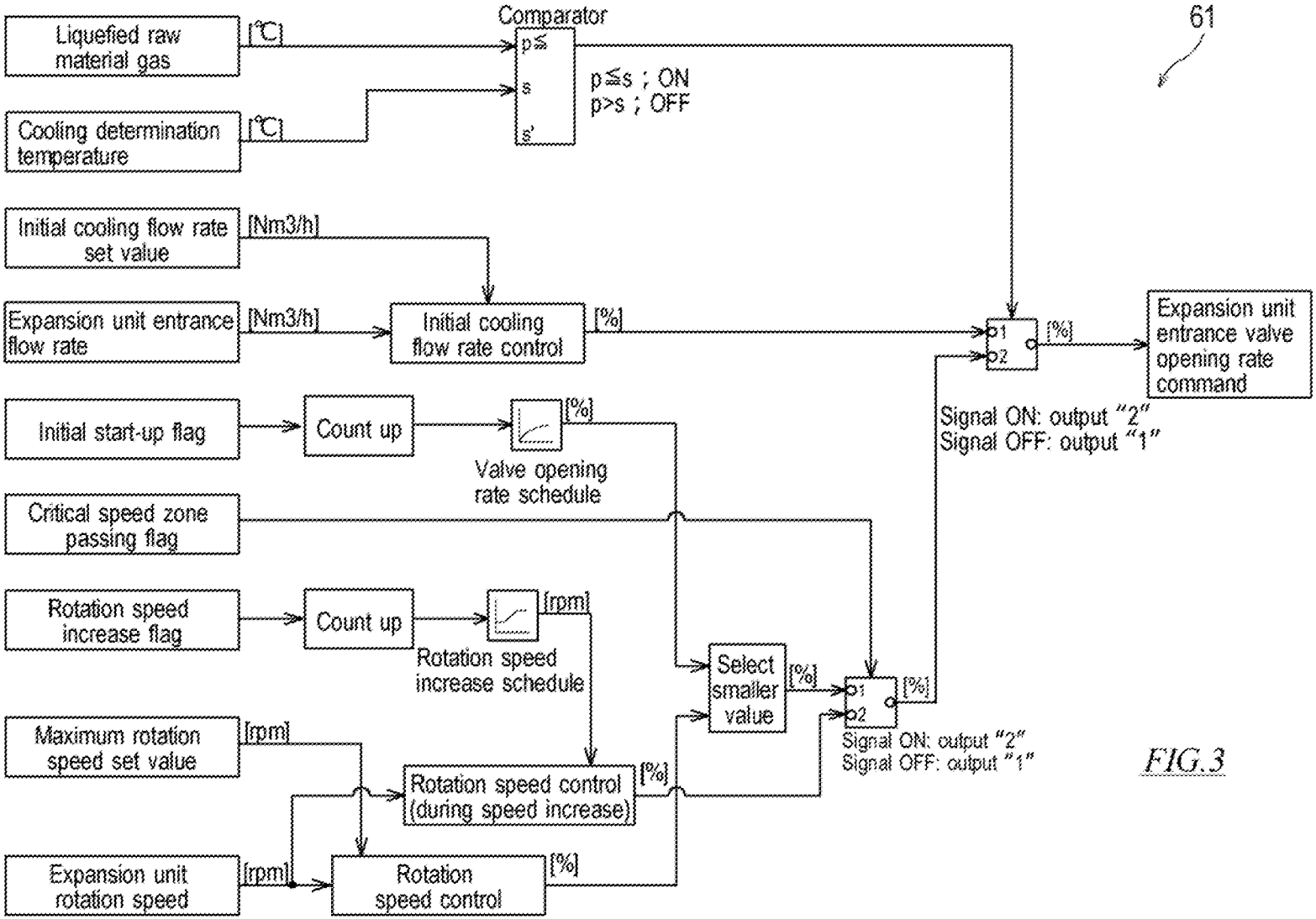
FIG. 3 is a view showing a flow of processing performed in a start-up control.
Figure 4:
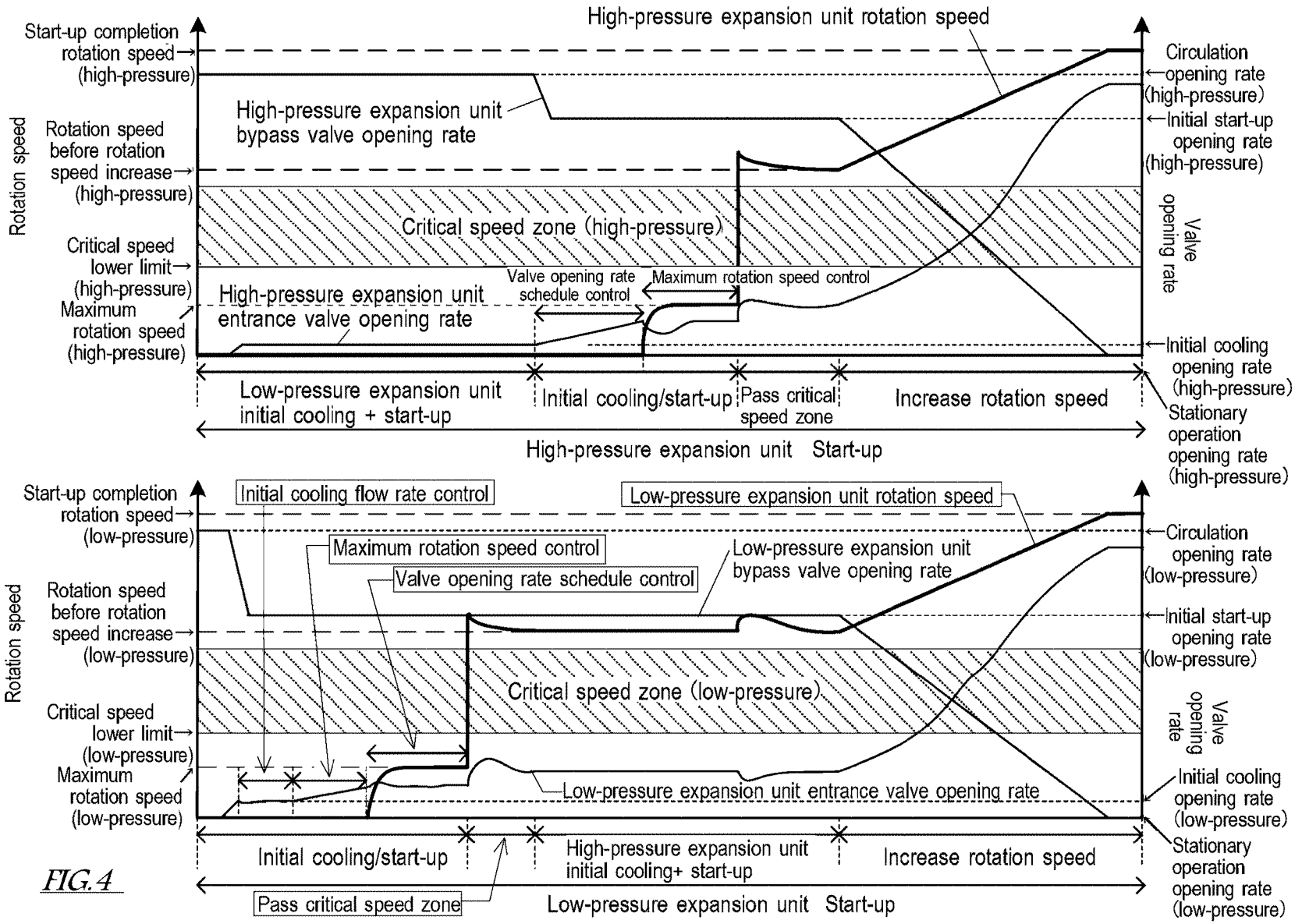
FIG. 4 is a timing chart of the start-up control.

Initially, the start-up control performed by the controller 6 will be described. FIG. 3 is a view showing a flow of processing performed in the start-up control. FIG. 4 is a timing chart of the start-up control. FIG. 3 shows a flow of the processing performed in the start-up control for the low-pressure expansion unit 38. The contents of the processing performed in the start-up control for the low-pressure expansion unit 38 and the contents of the processing performed in the start-up control for the high-pressure expansion unit 37 are substantially the same except used schedules and set values, etc. Therefore, the processing performed in the start-up control for the high-pressure expansion unit 37 will be described with reference to FIG. 3. In FIG. 4, an upper chart indicates changes over time of the high-pressure expansion unit rotation speed N1, the opening rate of the high-pressure expansion unit entrance valve 21, and the opening rate of the high-pressure expansion unit bypass valve 24, while a lower chart indicates changes over time of the low-pressure expansion unit rotation speed N2, the opening rate of the low-pressure expansion unit entrance valve 22, and the opening rate of the low-pressure expansion unit bypass valve 27. A time axis of the upper chart and a time axis of the lower chart correspond with each other.

As shown in FIGS. 3 and 4, the start-up control includes roughly four steps which are an initial cooling step, an initial (activation) start-up step, a critical speed zone passing step, and a rotation speed increasing step. The initial cooling step is performed before start-up (namely, rotation) of the expansion units 37, 38.

[Initial Cooling Step]

In a case where rotor shafts of the high-pressure expansion unit 37 and the low-pressure expansion unit 38 rotate in a state in which the high-pressure expansion unit 37 and the low-pressure expansion unit 38 and a region which is in the vicinity of the high-pressure expansion unit 37 and the low-pressure expansion unit 38 are not cooled to a liquid nitrogen temperature, and the rotation speeds of the rotor shafts fall into critical speed zones, shaft vibrations due to synchronous components of character frequencies and unstable vibrations due to non-synchronous components which are irrelevant to the character frequencies occur. If the shaft vibrations become excessive, seizure (seizing) of bearings may occur. To avoid this, in the initial cooling step, in a case where the whole of the raw material gas liquefying device 100 is in a room temperature state before the start-up, the whole of the device is initially cooled to a temperature that is almost equal to the temperature of the liquid nitrogen by the cooler 73 for initial cooling (nitrogen line 70).

In the initial cooling step, the opening rate (opening degree) of the low-pressure expansion unit bypass valve 27 is reduced from a predetermined circulation opening rate to a predetermined initial start-up opening rate. The opening rate of the low-pressure expansion unit bypass valve 27 is maintained at the initial start-up opening rate until the rotation speed increasing step is initiated.

In the initial cooling step, the opening rate of the high-pressure expansion unit entrance valve 21 is increased up to a predetermined initial cooling opening rate and maintained at the initial cooling opening rate. At the initial cooling opening rate, the high-pressure expansion unit entrance valve 21 is not closed and is slightly open. Therefore, when the high-pressure expansion unit entrance valve 21 has the initial cooling opening rate, the refrigerant with a flow rate which does not rotate the high-pressure expansion unit 37 is permitted to flow into the high-pressure expansion unit 37.

In the initial cooling step, before start-up (rotation) of the expansion units 37, 38 is performed, the opening rate of the low-pressure expansion unit entrance valve 22 is increased from the opening rate corresponding to the closed position of the valve 22 to a predetermined initial cooling opening rate. Therefore, when the low-pressure expansion unit entrance valve 22 has the initial cooling opening rate, the refrigerant with a flow rate which does not rotate the low-pressure expansion unit 38 is permitted to flow into the low-pressure expansion unit 38.

At a time point when the opening rate of the low-pressure expansion unit entrance valve 22 reaches the initial cooling opening rate, the controller 6 initiates an initial cooling flow rate control for the low-pressure expansion unit 38. In the initial cooling flow rate control for the low-pressure expansion unit 38, the controller 6 manipulates the opening rate of the low-pressure expansion unit entrance valve 22 and performs a feedback control so that the low-pressure expansion unit entrance-side flow rate F2 reaches a predetermined initial cooling flow rate set value. The initial cooling flow rate set value may be set to a refrigerant flow rate which does not rotate the rotor shaft of the low-pressure expansion unit 38 and is 80 to 90% or less of the refrigerant flow rate at which the rotor shaft begins to rotate.

The initial cooling flow rate control for the low-pressure expansion unit 38 is continued until the low-pressure expansion unit exit temperature T2 reaches a predetermined cooling determination temperature. At a time point when the low-pressure expansion unit exit temperature 12 has reached the predetermined cooling determination temperature, an initial start-up flag of the low-pressure expansion unit 38 is turned ON.

[Initial Start-Up Step for Low-Pressure Expansion Unit 38]

When the initial start-up flag of the low-pressure expansion unit 38 is turned ON, the controller 6 initiates the initial start-up step for the low-pressure expansion unit 38. In the initial start-up step for the low-pressure expansion unit 38, a schedule control for the opening rate of the low-pressure expansion unit entrance valve 22 or a rotation speed control is selectively performed.

The controller 6 begins to count-up in response to ON of the initial start-up flag as a trigger, and generates a first opening rate command with reference to a predetermined valve opening rate schedule. The valve opening rate schedule for the low-pressure expansion unit entrance valve 22 defines a relation between time that passes (proceeds) from the beginning of the count-up and a valve opening rate set value of the low-pressure expansion unit entrance valve 22. The controller 6 derives the valve opening rate set value corresponding to the time that passes from the beginning of the count-up, and generates a first opening rate command based on this valve opening rate set value.

In a state in which the initial start-up flag is ON, the controller 6 generates a second opening rate command by the rotation speed control. Specifically, the controller 6 generates a second opening rate command by performing a feedback control so that a controlled amount reaches a target value, in which the low-pressure expansion unit rotation speed N2 is the controlled amount, a predetermined maximum rotation speed set value is the target value, and the opening rate of the low-pressure expansion unit entrance valve 22 is a manipulation amount. The maximum rotation speed set value of the low-pressure expansion unit 38 is defined as the rotation speed lower than the critical speed zone of the low-pressure expansion unit 38. The critical speed zone is defined as a rotation speed zone which is unique to each of the expansion units 37, 38 and includes the rotation speed of the rotor shaft at which the turbine resonates, and a value that is close to this rotation speed.

The controller 6 compares the first opening rate command to the second opening rate command. The controller 6 outputs one of the first opening rate command and the second opening rate command which is smaller, as the opening rate command, to the low-pressure expansion unit entrance valve 22. Normally, at the beginning of the initial start-up step, the low-pressure expansion unit 38 is not rotating. The low-pressure expansion unit entrance valve 22 is manipulated in response to the first opening rate command in the valve opening rate schedule control. When the low-pressure expansion unit 38 begins to rotate with the increase of the opening rate of the low-pressure expansion unit entrance valve 22, the low-pressure expansion unit entrance valve 22 is manipulated in response to the second opening rate command in the rotation speed control. In this way, the valve opening rate schedule control automatically shifts to the rotation speed control. This allows the initial start-up to take place without a situation in which the rotation speed falls into the critical speed zone.

[Critical Speed Zone Passing Step for Low-Pressure Expansion Unit 38]

At a time point when the low-pressure expansion unit rotation speed N2 is stabilized at the maximum rotation speed set value, a critical speed zone passing flag is turned ON. The phrase "rotation speed of the expansion unit 37, 38 is stabilized" means that a state in which the rotation speed changes in a range of a predetermined value or less is continued over a predetermined time.

When the critical speed zone passing flag is turned ON, the controller 6 shifts the target value from the maximum rotation speed set value to a predetermined rotation speed set value before rotation speed increase in the rotation speed increasing step, and performs the rotation speed control. The predetermined rotation speed set value before rotation speed increase refers to the rotation speed which is outside (exceeds) the Critical speed zone.

The controller 6 generates the opening rate command by performing a feedback control so that a controlled amount reaches a target value, in which the low-pressure expansion unit rotation speed N2 is the controlled amount, the predetermined rotation speed set value before rotation speed increase is the target value, and the opening rate of the low-pressure expansion unit entrance valve 22 is a manipulation amount. The controller 6 outputs this opening rate command to the low-pressure expansion unit entrance valve 22. This allows the low-pressure expansion unit rotation speed N2 to be quickly increased to the predetermined rotation speed set value before rotation speed increase and quickly pass through the critical speed zone.

At a time point when the low-pressure expansion unit rotation speed N2 is stabilized at the rotation speed set value before rotation speed increase and the opening rate of the low-pressure expansion unit entrance valve 22 is stabilized, an initial start-up flag of the high-pressure expansion unit 37 is turned ON. Note that during the initial start-up step and the critical speed zone passing step for the high-pressure expansion unit 37 which will be described later, the controller 6 controls the opening rate of the low-pressure expansion unit entrance valve 22 so that the low-pressure expansion unit rotation speed. N2 is maintained at the predetermined rotation speed set value before rotation speed increase.

(Initial Cooling/Start-Up Step for High-Pressure Expansion Unit 37)

When the initial start-up flag of the high-pressure expansion unit 37 is turned ON, the controller 6 initiates the initial cooling/start-up step for the high-pressure expansion unit 37. As in the start-up control for the low-pressure expansion unit 38, the start-up control for the high-pressure expansion unit 37 includes an initial cooling step, an initial start-up step, a critical speed zone passing step, and a rotation speed increasing step.

As described above, in the initial cooling step, the refrigerant with a flow rate which does not rotate the rotor shaft has already flowed into the high-pressure expansion unit 37. By this refrigerant, the high-pressure expansion unit 37 and a region which is in the vicinity of the high-pressure expansion unit 37 are cooled while the initial start-up step and the critical speed zone passing step for the low-pressure expansion unit 38 are performed.

In the initial start-up step for the high-pressure expansion unit 37, a valve opening rate schedule control or a rotation speed control is selectively performed, as in the above-described initial start-up step for the low-pressure expansion unit 38.

Specifically, the controller 6 begins to count-up in response to ON of the initial start-up flag as a trigger, and generates a first opening rate command with reference to a predetermined valve opening rate schedule. Also, the controller 6 generates a second opening rate command by the rotation speed control. Specifically, the controller 6 generates the second opening rate command by performing a feedback control so that a controlled amount reaches a target value, in which the high-pressure expansion unit rotation speed N1 is the controlled amount, a predetermined maximum rotation speed set value is the target value, and the opening rate of the high-pressure expansion unit entrance valve 21 is a manipulation amount. The controller 6 compares the first opening rate command to the second opening rate command. The controller 6 outputs one of the first opening rate command and the second opening rate command which is smaller, as the opening rate command, to the high-pressure expansion unit entrance valve 21. This allows the initial start-up to take place without a situation in which the rotation speed falls into the critical speed zone.

[Critical Speed Zone Passing Step for High-Pressure Expansion Unit 37]

At a time point when the high-pressure expansion unit rotation speed N1 is stabilized at the maximum rotation speed, a critical speed zone passing flag is turned ON. When the critical speed zone passing flag is turned ON, the controller 6 initiates the critical speed zone passing step. In the critical speed zone passing step for the high-pressure expansion unit 37, the controller 6 shills the target value in the rotation speed control from a predetermined maximum rotation speed set value to a predetermined rotation speed set value before rotation speed increase in the rotation speed increasing step, as in the above-described critical speed zone passing step for the low-pressure expansion unit 38.

The controller 6 manipulates the opening rate of the high-pressure expansion unit entrance valve 21 and performs a feedback control so that the high-pressure expansion unit rotation speed N1 reaches the rotation speed set value before rotation speed increase. This allows the high-pressure expansion unit rotation speed N1 to be quickly increased up to the rotation speed set value before rotation speed increase and quickly pass through the critical speed zone.

[Rotation Speed Increasing Step]

At a time point when the high-pressure expansion unit rotation speed N1 has reached the rotation speed set value before rotation speed increase, a rotation speed increase flag is turned ON. When the rotation speed increase flag is turned ON, the controller 6 initiates the rotation speed increasing step for the high-pressure expansion unit 37 and the low-pressure expansion unit 38.

In the rotation speed increasing step, the controller 6 reduces the opening rate of the high-pressure expansion unit bypass valve 24 from the initial start-up opening rate to a predetermined stationary (steady) operation opening rate with a predetermined reduction rate. In the same manner, the controller 6 reduces the opening rate of the low-pressure expansion unit bypass valve 27 from the initial start-up opening rate to a predetermined stationary operation opening rate with a predetermined reduction rate.

In the rotation speed increasing step, the controller 6 begins to count-up when the rotation speed increase flag is turned ON. The controller 6 derives the target value of the rotation speed with reference to a predetermined rotation speed increase schedule, manipulates the opening rate of the high-pressure expansion unit entrance valve 21, and performs a feedback control so that the high-pressure expansion unit rotation speed N1 reaches the target value. As a result of this, the high-pressure expansion unit rotation speed N1 increases from the rotation speed set value before rotation speed increase to a rated rotation speed of the high-pressure expansion unit 37.

Likewise, the controller 6 derives the target value of the rotation speed with reference to the predetermined rotation speed increase schedule, manipulates the opening rate of the low-pressure expansion unit entrance valve 22, and performs a feedback control so that the low-pressure expansion unit rotation speed N2 reaches the target value. As a result, the low-pressure expansion unit rotation speed N2 increases from the rotation speed set value before rotation speed increase to a rated rotation speed of the low-pressure expansion unit 38.

Since each of the opening rate of the high-pressure expansion unit bypass valve 24 and the opening rate of the low-pressure expansion unit bypass valve 27 is reduced with the predetermined reduction rate irrespective of the rotation speed, it becomes possible to avoid interference with changes of the opening rate of the high-pressure expansion unit entrance valve 21 and the opening rate of the low-pressure expansion unit entrance valve 22 which are automatically adjusted by the rotation speed control. This makes it possible to prevent excessive rotation and rapid rotation speed increase of each of the expansion units 37, 38.

If the heat exchangers 81 to 86 are cooled or heated at a high pace due to rapid reduction or increase of the refrigerant temperature, for example, plate fins inside the heat exchanger may be damaged due to a heat shock. To reduce a load put on the heat exchangers 81 to 86, temperature changes of the heat exchangers 81 to 86 are required to be within a predetermined allowable range during start-up and stop of the expansion units 37, 38. In light of this, the rotation speed increase schedule for the high-pressure expansion unit 37 defines a relation between time and the rotation speed (target value) of the high-pressure expansion unit 37 so that the rotation speed of the high-pressure expansion unit 37 is increased from the rotation speed set value before rotation speed increase to the rated rotation speed while causing the temperature changes of the heat exchangers 81 to 86 to be within the predetermined allowable range. Likewise, the rotation speed increase schedule for the low-pressure expansion unit 38 defines a relation between time and the rotation speed (target value) of the low-pressure expansion unit 38 so that the rotation speed of the low-pressure expansion unit 38 is increased from the rotation speed set value before rotation speed increase to the rated rotation speed while causing the temperature changes of the heat exchangers 81 to 86 to be within the predetermined allowable range.

At a time point when the high-pressure expansion unit rotation speed N1 is stabilized at the rated rotation speed and the opening rate of the high-pressure expansion unit bypass valve 24 reaches the stationary (steady) operation opening rate, the controller 6 terminates the rotation speed increasing step for the high-pressure expansion unit 37, Likewise, at a time point when the low-pressure expansion unit rotation speed N2 is stabilized at the rated rotation speed and the opening rate of the low-pressure expansion unit bypass valve 27 reaches the stationary operation opening rate, the controller 6 terminates the rotation speed increasing step for the low-pressure expansion unit 38, In the rotation speed increase schedule for the high-pressure expansion unit 37 and the rotation speed increase schedule for the low-pressure expansion unit 38, the rotation speed increasing step for the high-pressure expansion unit 37 and the rotation speed increasing step for the low-pressure expansion unit 38 are scheduled to be terminated at almost the same timing. When the rotation speed increasing step for the high-pressure expansion unit 37 and the rotation speed increasing step for the low-pressure expansion unit 38 are terminated, the controller 6 terminates the start-up control for the high-pressure expansion unit 37 and the low-pressure expansion unit 38.

[Stop Control]

Next, the stop control performed by the controller 6 will be described.

Figure 5:
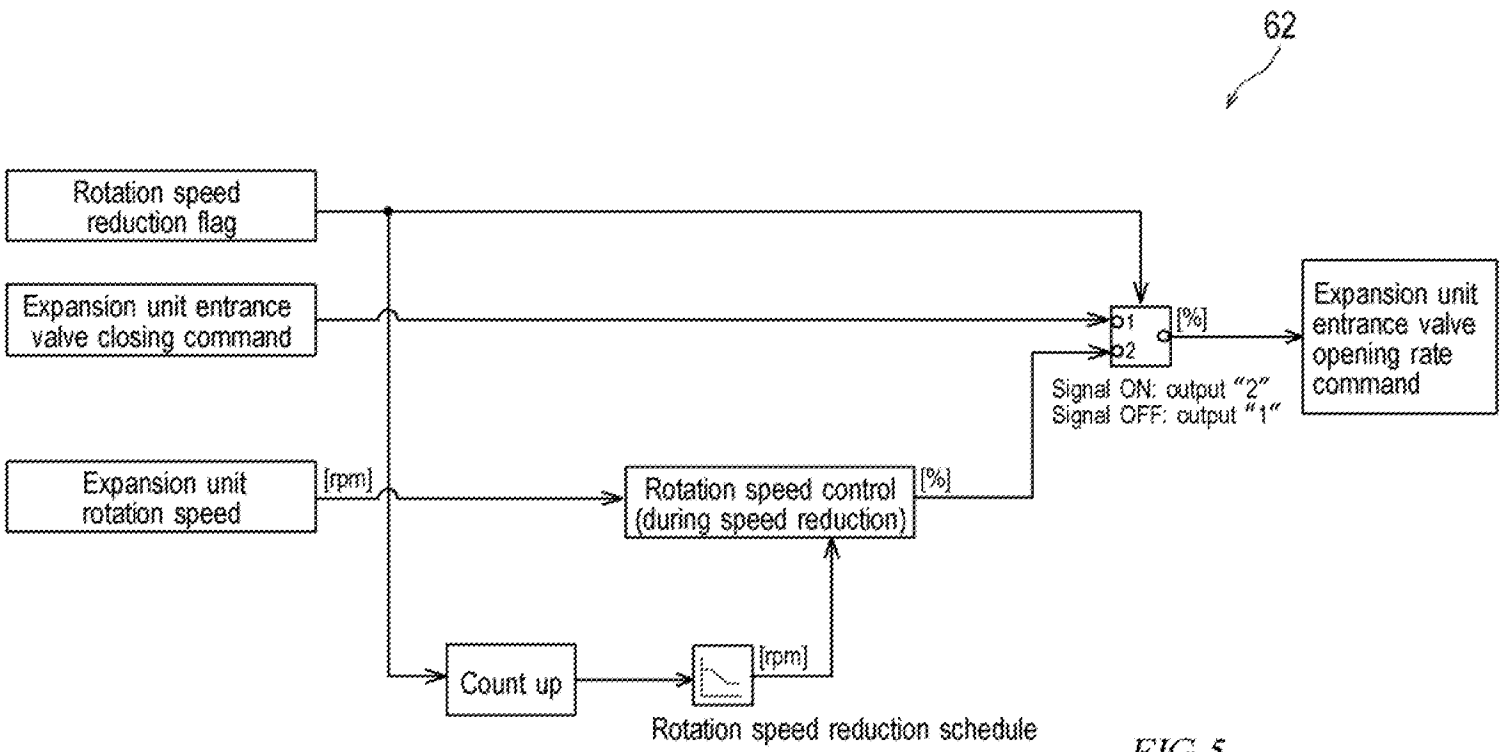
FIG. 5 is a view showing a flow of processing performed in a stop control.
Figure 6:
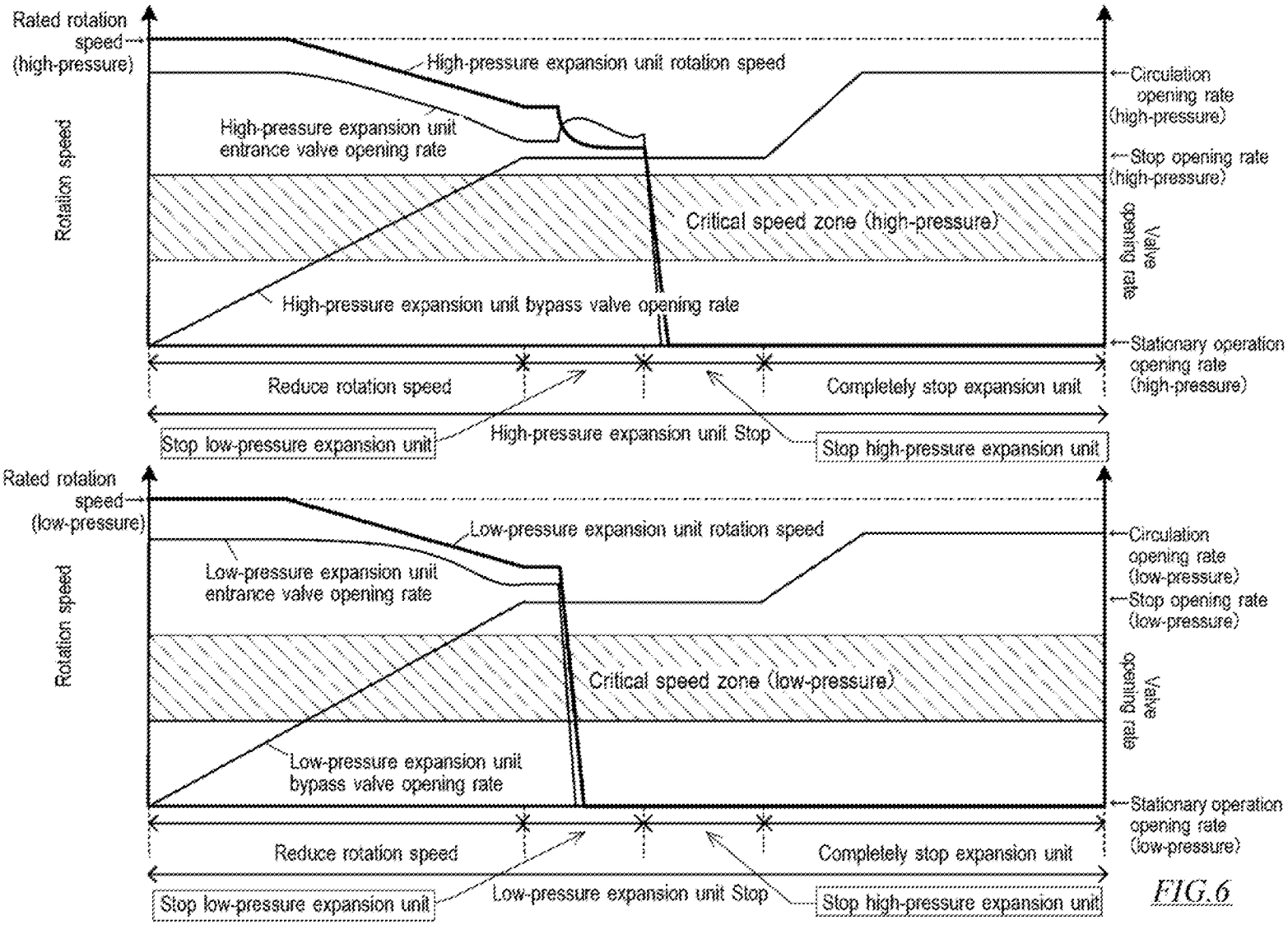
FIG. 6 is a timing chart of the stop control.

FIG. 5 is a view for explaining a flow of processing performed in the stop control. FIG. 6 is a timing chart of the stop control. FIG. 5 shows the flow of the processing performed the stop control for the low-pressure expansion unit 38. However, the stop control for the low-pressure expansion unit 38 and the stop control for the high-pressure expansion unit 37 are substantially the same except used schedules and set values, or the like. Therefore, the processing performed in the stop control for the high-pressure expansion unit 37 will be described with reference to FIG. 5. In FIG. 6, an upper chart indicates changes over time of the high-pressure expansion unit rotation speed N1, the opening rate of the high-pressure expansion unit entrance valve 21, and the opening rate of the high-pressure expansion unit bypass valve 24, while a lower chart indicates changes over time of the low-pressure expansion unit rotation speed N2, the opening rate of the low-pressure expansion unit entrance valve 22, and the opening rate of the low-pressure expansion unit bypass valve 27. The time axis of the upper chart and the time axis of the lower chart correspond with each other.

As shown in FIGS. 5 and 6, upon start of the stop control, the controller 6 increases the opening rate of the high-pressure expansion unit bypass valve 24 from the circulation opening rate to a stop opening rate with a predetermined increase rate, and increases the opening rate of the low-pressure expansion unit bypass valve 27 from the stationary operation opening rate to a stop opening rate with a predetermined increase rate.

Upon start of the stop control, a rotation speed reduction flag is turned ON, and the controller 6 begins to count-up, and derives the target value of the rotation speed of the high-pressure expansion unit 37 with reference to a predetermined rotation speed reduction schedule for the high-pressure expansion unit 37. Then, the controller 6 manipulates the opening rate of the high-pressure expansion unit entrance valve 21 and performs a feedback control so that the high-pressure expansion unit rotation speed N1 reaches the target value. As a result, the high-pressure expansion unit rotation speed N1 is reduced from the rated rotation speed of the high-pressure expansion unit 37 to a predetermined rotation speed before stop of the high-pressure expansion unit 37. The rotation speed reduction schedule for the high-pressure expansion unit 37 defines a relation between time and the rotation speed (target value) of the high-pressure expansion unit 37 so that the rotation speed of the high-pressure expansion unit 37 is reduced from the rated rotation speed to the rotation speed before stop while causing the temperature changes of the heat exchangers 81 to 86 to be within the predetermined allowable range.

Likewise, the controller 6 derives the target value of the rotation speed of the low-pressure expansion unit 38 with reference to a predetermined rotation speed reduction schedule for the low-pressure expansion unit 38. Then, the controller 6 manipulates the opening rate of the low-pressure expansion unit entrance valve 22 and performs a feedback control so that the low-pressure expansion unit rotation speed N2 reaches the target value. As a result, the low-pressure expansion unit rotation speed N2 is reduced from the rated rotation speed of the low-pressure expansion unit 38 to a predetermined rotation speed before stop of the low-pressure expansion unit 38. The predetermined rotation speed reduction schedule for the low-pressure expansion unit 38 defines a relation between time and the rotation speed (target value) of the low-pressure expansion unit 38 so that the rotation speed of the low-pressure expansion unit 38 is reduced from the rated rotation speed to the rotation speed before stop while causing the temperature changes of the heat exchangers 81 to 86 to be within the predetermined allowable range.

Since each of the opening rate of the high-pressure expansion unit bypass valve 24 and the opening rate of the low-pressure expansion unit bypass valve 27 is reduced with the predetermined increase rate irrespective of the rotation speed, it becomes possible to avoid interference with changes of the opening rate of the high-pressure expansion unit entrance valve 21 and the opening rate of the low-pressure expansion unit entrance valve 22 which are automatically adjusted by the rotation speed control. This makes it possible to prevent excessive rotation and rapid rotation speed reduction of the expansion units 37, 38.

At a time point when the high-pressure expansion unit rotation speed N1 is stabilized at the rotation speed before stop and the opening rate of the high-pressure expansion unit bypass valve 24 reaches the stop opening rate, speed reduction of the high-pressure expansion unit 37 is stopped. At a time point when the low-pressure expansion unit rotation speed N2 is stabilized at the rotation speed before stop and the opening rate of the low-pressure expansion unit bypass valve 27 reaches the stop opening rate, speed reduction of the low-pressure expansion unit 38 is stopped. In a state in which both of the expansion units 37, 38 are stopped, the rotation speed reduction flag is turned OFF.

In a state in which the rotation speed reduction flag is OFF, the controller 6 outputs opening rate commands directing closing to the high-pressure expansion unit entrance valve 21 and the low-pressure expansion unit entrance valve 22. In response to this, the high-pressure expansion unit entrance valve 21 is closed, and the high-pressure expansion unit rotation speed N1 is rapidly reduced to 0 and quickly passes through the critical speed zone. Likewise, the low-pressure expansion unit entrance valve 22 is closed, and the low-pressure expansion unit rotation speed N2 is rapidly reduced to 0, and passes through the critical speed zone. In this way, the expansion units 37, 38 quickly pass through the critical speed zones, respectively. Therefore, the expansion units 37, 38 can be stopped while avoiding excessive shaft vibrations. After the above-described control is completed, each of the opening rate of the high-pressure expansion unit bypass valve 24 and the opening rate of the low-pressure expansion unit bypass valve 27 is increased from the stop opening rate to the circulation opening rate with a predetermined increase rate.

As described above, the raw material gas liquefying device 100 according to the present embodiment includes the feed line 1 which feeds therethrough the raw material gas whose boiling temperature is lower than that of the nitrogen gas, the refrigerant circulation line 3 which circulates therethrough the refrigerant for cooling the raw material gas, the refrigerant circulation line 3 including the expansion units 37, 38 of the turbine type, which expand the refrigerant to generate the cryogenic energy (cold energy), and the expansion unit entrance valves 21, 22 provided at the entrance side of the expansion units 37, 38, respectively, the heat exchangers 81 to 86 which exchange heat between the raw material gas and the refrigerant, the cooler 73 which performs the initial cooling of the raw material gas and the refrigerant by the heat exchange with the liquid nitrogen, the expansion unit rotation speed sensors 56, 57 which detect the rotation speeds N1, N2, respectively, of the expansion units 37, 38, and the controller 6 which controls the operations associated with the feed line 1 and the refrigerant circulation line 3.

At the start-up and stop of the expansion units 37, 38, the controller 6 generates the opening rate commands for the expansion unit entrance valves 21, 22 by performing the feedback control so that the rotation speeds N1, N2 of the expansion units 37, 38 reach the predetermined target values, respectively, and outputs the opening rate commands to the expansion unit entrance valves 21, 22, respectively.

In the method of controlling the raw material gas liquefying device 100 according to the present embodiment, at the start-up and stop of the expansion units 37, 38, the opening rates of the expansion unit entrance valves 21, 22 are manipulated, and the feedback control is performed so that the rotation speeds N1, N2 of the expansion units 37, 38 reach the predetermined target values, respectively.

In the raw material gas liquefying device 100 and the control method thereof (therefor), described above, at the start-up and stop of the expansion units 37, 38, the rotation speeds of the expansion units 37, 38 are directly controlled, rather than the valve opening rates of the expansion unit entrance valves 21, 22. This makes it possible to control the cryogenic energy (cold energy) generated in the expansion units 37, 38, at the start-up and stop of the expansion units 37, 38. Even in a case where the operation (running) characteristics of the expansion units 37, 38 change, it becomes possible to avoid a situation in which the rotation speeds of the expansion units 37, 38 unexpectedly fall into the critical speed zones at the start-up and stop of the expansion units 37, 38. Since the rotation speeds of the expansion units 37, 38 are controlled so that the rotation speeds quickly pass through the critical speed zones, the shaft vibrations of the expansion units 37, 38 can be suppressed: As a result, it becomes possible to avoid damages due to excessive shaft vibrations of the expansion units 37, 38, for example, seizure of the bearings of the expansion units 37, 38.

In the raw material gas liquefying device 100 and the control method thereof (therefor) according to the present embodiment, the controller 6 generates the opening rate commands for the expansion unit entrance valves 21, 22 and outputs this opening rate command to the expansion unit entrance valves 21, 22 so that the refrigerant which has gone through (has been subjected to) the initial cooling and has the predetermined initial cooling flow rate which does not rotate the expansion units 37, 38 is introduced into the expansion units 37, 38, before the start-up of the expansion units 37, 38.

Thus, before the star-up of the expansion units 37, 38, the controller 6 manipulates the opening rate of the expansion unit entrance valve 22 to control the cooling flow rate so that the refrigerant with the initial cooling flow rate which does not rotate the expansion unit 38 is introduced into the expansion unit 38. This makes it possible to cool the expansion unit 38 and a region that is in the vicinity of the expansion unit 38 without rotating the expansion unit 38. Compared to the method disclosed in Patent Literature 1 in which the expansion unit 38 and a region that is in the vicinity of the expansion unit 38 are cooled by utilizing shaft seal leakage of the bearing of the expansion unit 38, restriction of the flow rate of the refrigerant is less, and time taken from start of the cooling until completion of the start-up of the expansion units 37, 38 can be reduced.

Although in the above-described embodiment, the initial cooling flow rate control for the low-pressure expansion unit 38 is performed, the initial cooling flow rate control for the high-pressure expansion unit 37 may be performed in the same manner.

In the raw material gas liquefying device 100 and the control method thereof (therefor) according to the present embodiment, at the start-up of the expansion units 37, 38, the controller 6 derives the first opening rate commands for the expansion unit entrance valves 21, 22 with reference to the predetermined valve opening rate schedules which increase the rotation speeds of the expansion units 37, 38 up to the predetermined maximum rotation speed set values lower than the critical speed zone of the high-pressure expansion unit 37, derives the second opening rate commands for the expansion unit entrance valves 21, 22 by performing the feedback control so that the rotation speed of the high-pressure expansion unit 37 reaches the maximum rotation speed set value which is the target value, and outputs one of the first and second opening rate commands which is smaller, to each of the expansion unit entrance valves 21, 22.

In accordance with the above-described valve opening rate schedule control, even in a case where the operation characteristics (rotation start and stop characteristics) of the expansion units 37, 38 are varied, due to, for example, deterioration of the components of the expansion units 37, 38, which progresses over time, and adhesion of impurities contained in the refrigerant to the turbine bearings, the initial start-up of the expansion units 37, 38 can be initiated. In accordance with the rotation speed control in which the maximum rotation speed is the target value, even in a case where the expansion units 37, 38 tend to rotate excessively just after the expansion units 37, 38 begin to rotate, it becomes possible to prevent a situation in which the rotation speeds of the expansion units 37, 37 rapidly fall into the critical speed zones.

In the raw material gas liquefying device 100 and the control method thereof (therefor) according to the present embodiment, in a case where the rotation speeds of expansion units 37, 38 are increased from the predetermined rotation speeds before rotation speed increase in the rotation speed increasing steps, which are outside the critical speed zones of the expansion units 37, 38, to the rated rotation speeds of the expansion units 37, 38, at the start-up of the expansion units 37, 38, the controller 6 decides the target values in the rotation speed controls with reference to the predetermined rotation speed increase schedules which increase the rotation speeds of expansion units 37, 38, while causing the temperature changes of the heat exchangers 81 to 86 which are associated with the changes of the rotation speeds of expansion units 37, 38 to be within the predetermined allowable range.

In the same manner, in the raw material gas liquefying device 100 and the control method thereof (therefor) according to the present embodiment, in a case where the rotation speeds of the expansion units 37, 38 are reduced from the rated rotation speeds of the expansion units 37, 38 to the predetermined rotation speeds before stop of the expansion units 37, 38 which are outside the critical speed zones of the expansion units 37, 38, at the stop of the expansion units 37, 38, the controller 6 decides the target values in the rotation speed controls with reference to the predetermined rotation speed reduction schedules which reduce the rotation speeds of expansion units 37, 38, while causing the temperature changes of the heat exchangers 81 to 86 which are associated with the changes of the rotation speeds of expansion units 37, 38 to be within the predetermined allowable range.

As described above, since the rotation speed of the high-pressure expansion unit 37 and the rotation speed of the low-pressure expansion unit 38 are gradually increased according to the rotation speed increase schedules, or gradually reduced according to the rotation speed reduction schedules, the temperature increases of the heat exchangers 81 to 86 due to deficiency of the cryogenic (cold) energy generated in the high-pressure expansion unit 37 and the low-pressure expansion unit 38 can be suppressed within the allowable range. This makes it possible to prevent damages to the plate fins of the heat exchangers 81 to 86, which would otherwise be caused by the heat shock.

In the raw material gas liquefying device 100 and the control method thereof (therefor) according to the present embodiment, the expansion units 37, 38 include the high-pressure expansion unit 37 and the low-pressure expansion unit 38 disposed downstream of the high-pressure expansion unit 37, while the expansion unit entrance valves 21, 22 include the high-pressure expansion unit entrance valve 21 provided at the entrance side of the high-pressure expansion unit 37 and the low-pressure expansion unit entrance valve 22 provided at the entrance side of the low-pressure expansion unit 38. The controller 6 controls the rotation speed of the high-pressure expansion unit 37 and the rotation speed of the low-pressure expansion unit 38 so that the rotation speed of the high-pressure expansion unit 37 reaches the predetermined rotation speed before rotation speed increase of the high-pressure expansion unit 37 which is outside the critical speed zone of the high-pressure expansion unit 37 after the rotation speed of the low-pressure expansion unit 38 has reached the predetermined rotation speed before rotation speed increase which is outside the critical speed zone of the low-pressure expansion unit 38, and that the rotation speed of the high-pressure expansion unit 37 and the rotation speed of the low-pressure expansion unit 38 are increased from their rotation speeds before rotation speed increase to their rated rotation speeds after the rotation speed of both of the high-pressure expansion unit 37 and the rotation speed of the low-pressure expansion unit 38 have reached their rotation speeds before rotation speed increase.

As described above, after the rotation speed of the high-pressure expansion unit 37 and the rotation speed of the low-pressure expansion unit 38 have reached their rotation speeds before rotation speed increase which are outside (exceed) the critical speed zones, the rotation speed of the high-pressure expansion unit 37 and the rotation speed of the low-pressure expansion unit 38 are increased up to their rated rotation speeds, respectively. This makes it possible to reliably avoid a situation in which the rotation speed of the high-pressure expansion unit 37 and the rotation speed of the low-pressure expansion unit 38 unexpectedly fall into the critical speed zones. There is a difference in timing at which the rotation speed passes the critical speed zone (in other words, timing at which the rotation speed rapidly changes) between the high-pressure expansion unit 37 and the low-pressure expansion unit 38. Therefore, it becomes possible to perform the start-up control more stably while suppressing shaft vibrations.

Thus far, the preferred embodiment of the present invention has been described. The specific structures and/or the details of the function of the above-described embodiment may be changed within the scope of the invention. For example, the configuration of the raw material gas liquefying device 100 can be changed as follows.

In the raw material gas liquefying device 100 according to the above-described embodiment, two expansion units 37, 38 are provided. The number of them depends on performance of the expansion units 37, 38 and is not limited to two of the above-described embodiment.

For example, one expansion saint may be provided. In this case, the operation of the raw material gas liquefying device 100 is controlled in substantially the same manner as that in the above-described embodiment, except that the start-up control and the stop control of the high-pressure expansion unit 37 are omitted. Further, for example, three or more expansion units may be provided. In this case, the operation of the raw material gas liquefying device 100 is controlled in substantially the same manner as that in the above-described embodiment, except that the start-up control and the stop control for the added expansion unit, which are the same as those for the high-pressure expansion unit 37, are added.

In the raw material gas liquefying device 100 according to the above-described embodiment, after the initial start-up step and the critical speed zone passing step for the low-pressure expansion unit 38 are performed, the initial start-up step and the critical speed zone passing step for the high-pressure expansion unit 37 are performed. The order of these steps may be reversed between the high-pressure expansion unit 37 and the low-pressure expansion unit 38. Specifically, after the initial start-up step and the critical speed zone passing step for the high-pressure expansion unit 37 are performed, the initial start-up step and the critical speed zone passing step for the low-pressure expansion unit 38 may be performed. In this case, before the initial start-up step for the high-pressure expansion unit 37, the controller 6 generates the opening rate command for the high-pressure expansion unit entrance valve 21 so that the refrigerant which has gone through (has been subjected to) the initial cooling and has the predetermined initial cooling flow rate which does not rotate the high-pressure expansion unit 37 is introduced into the high-pressure expansion unit 37, and outputs this opening rate command to the high-pressure expansion unit entrance valve 21.

The raw material gas liquefying device 100 according to the above-described embodiment includes two compressors 32, 33, and the heat exchangers 81 to 86 at six stages. The number of the compressors 32, 33 and the number of the heat exchangers 81 to 86 depend on the performance of the compressors 32, 33 and the performance of the heat exchangers 81 to 86, and are not limited to the above-described embodiment.

REFERENCE SIGNS LIST

1 feed line
3 refrigerant circulation line
6 controller
16 feed system Joule-Thomson valve
20 liquefier
21 high-pressure expansion unit entrance valve
22 low-pressure expansion unit entrance valve
23 high-pressure expansion unit bypass flow path
24 high-pressure expansion unit bypass valve
26 low-pressure expansion unit bypass flow path
27 low-pressure expansion unit bypass valve
31C cryogenic energy generation flow path
32 low-pressure compressor
33 high-pressure compressor
376 circulation system Joule-Thomson valve
37 high-pressure expansion unit
38 low-pressure expansion unit
40 liquefied refrigerant storage tank
41 refrigerant liquefaction route
42 cryogenic energy generation route
51 high-pressure expansion unit exit temperature sensor
52 low-pressure expansion unit exit temperature sensor
56 high-pressure expansion unit rotation speed sensor
57 low-pressure expansion unit rotation speed sensor
58 high-pressure expansion unit entrance-side flow rate sensor
59 low-pressure expansion unit entrance-side flow rate sensor
61 start-up control section
62 stop control section
70 nitrogen line
71 liquid nitrogen storage tank
73 cooler for initial cooling
81 to 86 heat exchanger
88 cooler
100 raw material gas liquefying device

The invention claimed is:

1. A raw material gas liquefying device comprising:
a feed line which feeds a raw material gas whose boiling temperature is lower than a boiling temperature of nitrogen;
a refrigerant circulation line which circulates a refrigerant for cooling the raw material gas, the refrigerant circulation line including an expansion unit of a turbine type which expands the refrigerant to generate cryogenic energy, and an expansion unit entrance valve provided at an entrance side of the expansion unit;
a heat exchanger which exchanges heat between the raw material gas and the refrigerant;
a cooler which performs initial cooling of the raw material gas and the refrigerant by heat exchange with liquid nitrogen;
an expansion unit rotation speed sensor which detects a rotation speed of the expansion unit; and
a controller configured to manipulate an opening rate of the expansion unit entrance valve, wherein:
before start-up of the expansion unit, the opening rate of the expansion unit entrance valve is manipulated so that the expansion unit entrance valve opened and a flow rate of the refrigerant flowing into the expansion unit is reaching a predetermined initial cooling flow rate, a flow of the refrigerant with the predetermined initial cooling flow rate through the expansion unit does not rotate the expansion unit, and
at the start-up and stop of the expansion unit, the opening rate of the expansion unit entrance valve is manipulated, by performing a feedback control, so that the rotation speed of the expansion unit reaches a predetermined target value.

2. The raw material gas liquefying device according to claim 1,
wherein at the start-up of the expansion unit,
the controller is configured to:
generate a first opening rate for the expansion unit entrance valve with reference to a predetermined valve opening rate schedule which increases the rotation speed of the expansion unit to a predetermined maximum rotation speed set value which is lower than a critical speed zone of the expansion unit;
generate a second opening rate for the expansion unit entrance valve by performing a feedback control so that the rotation speed of the expansion unit reaches the predetermined maximum rotation speed set value which is the target value; and
manipulate the opening rate of the expansion unit entrance valve to one of the first opening rate and the second opening rate which is smaller.

3. The raw material gas liquefying device according to claim 1,
wherein in a case where the rotation speed of the expansion unit is increased from a predetermined rotation speed which is outside a critical speed zone of the expansion unit, to a rated rotation speed of the expansion unit, at start-up of the expansion unit,
the controller is configured to decide the target value with reference to a predetermined rotation speed increase schedule which increases the rotation speed of the expansion unit while causing a temperature change of the heat exchanger which is associated with a change of the rotation speed of the expansion unit to be within a predetermined allowable range.

4. The raw material gas liquefying device according to claim 1, wherein in a case where the rotation speed of the expansion unit is reduced from a rated rotation speed of the expansion unit to a predetermined rotation speed before stop of the expansion unit, which is outside a critical speed zone of the expansion unit, at stop of the expansion unit, the controller is configured to decide the target value with reference to a predetermined rotation speed reduction schedule which reduces the rotation speed of the expansion unit while causing a temperature change of the heat exchanger which is associated with a change of the rotation speed of the expansion unit to be within a predetermined allowable range.

5. The raw material gas liquefying device according to claim 1, wherein the expansion unit includes a high-pressure expansion unit and a low-pressure expansion unit disposed downstream of the high-pressure expansion unit, wherein the expansion unit entrance valve includes a high-pressure expansion unit entrance valve provided at an entrance side of the high-pressure expansion unit, and a low-pressure expansion unit entrance valve provided at an entrance side of a low-pressure expansion unit, and wherein the controller is configured to control the rotation speed of the low-pressure expansion unit and the rotation speed of the high-pressure expansion unit so that the rotation speed of the high-pressure expansion unit reaches a predetermined rotation speed which is outside a critical speed zone of the high-pressure expansion unit after the rotation speed of the low-pressure expansion unit has reached a predetermined rotation speed which is outside a critical speed zone of the low-pressure expansion unit, and so that the rotation speed of the high-pressure expansion unit is increased from the predetermined rotation speed to a rated rotation speed of the high-pressure expansion unit, and the rotation speed of the low-pressure expansion unit is increased from the predetermined rotation speed to a rated rotation speed of the low-pressure expansion unit, after the rotation speed of the high-pressure expansion unit has reached the predetermined rotation speed and the rotation speed of the low-pressure expansion unit has reached the predetermined rotation speed.

6. A method of controlling a raw material gas liquefying device including:

a feed line which feeds a raw material gas whose boiling temperature is lower than a boiling temperature of nitrogen;

a refrigerant circulation line which circulates a refrigerant for cooling the raw material gas, the refrigerant circulation line including a turbine expansion unit which expands the refrigerant to generate cryogenic energy, and an expansion unit entrance valve provided at an entrance side of the expansion unit;

a heat exchanger which exchanges heat between the raw material gas and the refrigerant;

a cooler which performs initial cooling of the raw material gas and the refrigerant by heat exchange with liquid nitrogen; and a controller which controls operations associated with the feed line and the refrigerant circulation line, the method comprising:

before start-up of the expansion unit, manipulating an opening rate of the expansion unit entrance valve so that the expansion unit entrance valve is opened and a flow rate of the refrigerant flowing into the expansion unit is reaching a predetermined initial cooling flow rate, a flow of the refrigerant with the predetermined initial cooling flow rate through the expansion unit does not rotate the expansion unit, and at the start-up and stop of the expansion unit, manipulating the opening rate of the expansion unit entrance valve, by performing a feedback control, so that a rotation speed of the expansion unit reaches a predetermined target value.

7. The method of controlling the raw material gas liquefying device according to claim 6, wherein at the start-up of the expansion unit, a first opening rate for the expansion unit entrance valve is generated with reference to a predetermined valve opening rate schedule which increases the rotation speed of the expansion unit to a predetermined maximum rotation speed set value which is lower than a critical speed zone of the expansion unit, a second opening rate for the expansion unit entrance valve is generated by performing the feedback control so that the rotation speed of the expansion unit reaches the predetermined maximum rotation speed set value which is the target value, and the opening rate of the expansion unit entrance valve is manipulated to one of the first opening rate and the second opening rate whichever is smaller.

8. The method of controlling the raw material gas liquefying device according to claim 6, in a case where the rotation speed of the expansion unit is increased from a predetermined rotation speed which is outside a critical speed zone of the expansion unit, to a rated rotation speed of the expansion unit, at the start-up of the expansion unit, the target value is derived with reference to a predetermined rotation speed increase schedule which increases the rotation speed of the expansion unit while causing a temperature change of the heat exchanger which is associated with a change of the rotation speed of the expansion unit to be within a predetermined allowable range.

9. The method of controlling the raw material gas liquefying device according to claim 6, wherein in a case where the rotation speed of the expansion unit is reduced from a rated rotation speed of the expansion unit to a predetermined rotation speed before the stop of the expansion unit, which is outside a critical speed zone of the expansion unit, at the stop of the expansion unit, the target value is derived with reference to a predetermined rotation speed reduction schedule which reduces the rotation speed of the expansion unit while causing a temperature change of the heat exchanger which is associated with a change of the rotation speed of the expansion unit to be within a predetermined allowable range.

10. The method of controlling the raw material gas liquefying device according to claim 6, wherein the expansion unit includes a high-pressure expansion unit and a low-pressure expansion unit disposed downstream of the high-pressure expansion unit, wherein the expansion unit entrance valve includes a high-pressure expansion unit entrance valve provided at an entrance side of the high-pressure expansion unit, and a low-pressure expansion unit entrance valve provided at an entrance side of a low-pressure expansion unit, and wherein the rotation speed of the low-pressure expansion unit and the rotation speed of the high-pressure expansion unit are controlled so that the rotation speed of the high-pressure expansion unit reaches a predetermined rotation speed which is outside a critical speed zone of the high-pressure expansion unit after the rotation speed of the low-pressure expansion unit has reached a predetermined rotation speed which is outside a critical speed zone of the low-pressure expansion unit, and so that the rotation speed of the high-pressure expansion unit is increased from the predetermined rotation speed to a rated rotation speed of the high-pressure expansion unit, and the rotation speed of the low-pressure expansion unit is increased from the predetermined rotation speed to a rated rotation speed of the low-pressure expansion unit, after the rotation speed of the high-pressure expansion unit has reached the predetermined rotation speed and the rotation speed of the low-pressure expansion unit has reached the predetermined rotation speed.

* * * * *